US007381321B2

(12) United States Patent
Benazzi et al.

(10) Patent No.: US 7,381,321 B2
(45) Date of Patent: Jun. 3, 2008

(54) PROCESS FOR IMPROVING AROMATIC AND NAPHTHENO-AROMATIC GAS OIL FRACTIONS

(75) Inventors: Eric Benazzi, Chatou (FR); Patrick Bourges, Rueil Malmaison (FR); Christophe Gueret, St Romain en Gal (FR); Pierre Marion, Antony (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 614 days.

(21) Appl. No.: 10/367,965

(22) Filed: Feb. 19, 2003

(65) Prior Publication Data

US 2004/0159581 A1 Aug. 19, 2004

(30) Foreign Application Priority Data

Feb. 15, 2002 (FR) ..... 02 01971

(51) Int. Cl.
*C10G 65/12* (2006.01)

(52) U.S. Cl. ..... 208/89; 208/15; 208/57; 208/58; 208/59; 208/109; 208/110; 208/111.01; 208/111.15; 208/111.2; 208/111.3; 208/111.35; 208/143

(58) Field of Classification Search ..... 208/111.1, 208/143, 109, 110, 111.2, 111.3, 15, 57, 58, 208/59, 89, 111.01, 111.15, 111.35
See application file for complete search history.

(56) References Cited

U.S. PATENT DOCUMENTS

| | | | | |
|---|---|---|---|---|
| 3,306,839 A | | 2/1967 | Vaell | |
| 3,637,484 A | * | 1/1972 | Hansford | 208/143 |
| 3,703,461 A | * | 11/1972 | Hansford et al. | 208/143 |
| 5,118,406 A | | 6/1992 | Kokayeff et al. | |
| 5,762,902 A | * | 6/1998 | Benazzi et al. | 423/700 |
| 6,344,135 B1 | * | 2/2002 | Benazzi et al. | 208/111.01 |
| 6,387,246 B1 | | 5/2002 | Benazzi et al. | |
| 2001/0000006 A1 | * | 3/2001 | Kasztelan et al. | 208/111.2 |

FOREIGN PATENT DOCUMENTS

| | | | |
|---|---|---|---|
| EP | 0093552 | | 11/1983 |
| EP | 0611816 A1 | | 8/1994 |
| EP | 0848992 | | 6/1998 |
| WO | 0277718 | * | 8/1988 |

* cited by examiner

*Primary Examiner*—Glenn Caldarola
*Assistant Examiner*—Prem C. Singh
(74) *Attorney, Agent, or Firm*—Millen, White, Zelano, Branigan, P.C.

(57) ABSTRACT

Process for transforming a gas-oil fraction that makes it possible to produce a fuel that has a quality according to stringent requirements in terms of sulfur content, aromatic compound content, cetane number, boiling point, T95, of 95% of the compounds and density, d15/4, at 15° C. This process comprises a hydrorefining stage and a hydrocracking stage, whereby the latter uses a catalyst that contains at least one zeolite. The conversion of products that have a boiling point of less than 150° C. is, throughout the two stages of hydrocracking and hydrorefining, less than 40% by weight and, for the hydrorefining stage, between 1 and 15% by weight. The temperature, TR2, of the hydrocracking stage is less than the temperature, TR1, of the hydrorefining stage, and the variation between temperatures TR1 and TR2 is between 0 and 80° C.

14 Claims, No Drawings

PROCESS FOR IMPROVING AROMATIC AND NAPHTHENO-AROMATIC GAS OIL FRACTIONS

This invention relates to the field of fuels for internal combustion engines. It relates more particularly to the conversion of a gas oil fraction and in particular the production of a fuel for a compression-ignition engine. It also relates to the thus obtained fuel.

Currently, the gas oil fractions, whether they are obtained from direct distillation of a crude oil or whether they are obtained from a conversion process such as catalytic cracking, also contain non-negligible amounts of aromatic compounds, and nitrogen- and sulfur-containing compounds.

Within the legislative framework of most of the industrialized countries, there are requirements that relate to the maximum content of these products in fuels. Other requirements are also applied to fuels, such as the cetane number that should be above a certain threshold, the density, d15/4, at 15° C., and the boiling point, T95, (ASTM D86 method) of 95% of the components, whereby these last two should be below a certain limit.

Currently in Europe, a fuel should have a cetane number that is higher than 51, a sulfur content that is less than 350 ppm (parts per million by mass), a density d15/4, at 15° C. less than 0.845 g/cm$^3$, a content of polyaromatic compounds that is less than 11% by weight and a boiling point, T95, of 95% of its components that is less than 360° C.

These requirements, however, will be the object of revisions aimed at making them still more restricting. For example, in Europe, provisions are being made for 2005 to reduce the maximum sulfur content requirement to 50 ppm, and even 10 ppm in some countries. These restricting revisions, however, will not be limited only to the sulfur content. It is also being considered to increase the threshold of the cetane number to 58, and even to a higher value in some countries, as well as to reduce the maximum density d15/4 to 0.825 g/cm$^3$, the maximum content of polyaromatic compounds to 1% by weight, and the maximum temperature T95 to 340° C.

It is therefore necessary to develop reliable, effective and economically viable processes that make it possible to produce fuels that have improved characteristics as regards the cetane number, the content of polyaromatic, sulfur and nitrogen compounds, as well as the density, d15/4, at 15° C., and the boiling point, T95, of 95% of the components of the fuel.

Processes such as high-pressure hydrocracking make it possible to produce, from heavy feedstocks such as vacuum distillates, gas oil fractions that have a good quality and that meet current requirements. The investment for such a unit, however, is generally high. Furthermore, this type of process is often inadequate and inappropriate for gas oil fractions of average, and even mediocre, quality.

The gas oil fractions are generally obtained either from direct distillation of crude or from catalytic cracking: i.e., light distillate fractions (English initials LCO for Light Cycle Oil), heavy fractions (English initials HCO for Heavy Cycle Oil), or from another conversion process (coking, visbreaking, residue hydroconversion, etc.) or else gas oils that are obtained from aromatic or naphtheno-aromatic crude petroleum distillation of Cerro-Negro, Zuata, or El Pao type. It is particularly important to produce an effluent that can be directly and integrally upgraded as a fuel fraction of very high quality.

The standard processes, such as high-pressure hydrocracking, make it possible to increase the cetane number, to reduce the sulfur content and to satisfy the current requirements for certain feedstocks that already initially have advantageous qualities. However, in the case of gas oil fractions that are obtained from a catalytic cracking-type conversion process such as the LCO or else gas oil fractions that are obtained from the distillation of crude oils, i.e., gas oil fractions that have high contents of aromatic or naphtheno-aromatic compounds, the improvement in the quality of this gas oil fraction in terms of cetane number, sulfur content, density, d15/4, at 15° C., boiling point, T95, of 95% of the components and contents of polyaromatic compounds, reaches limits that cannot be exceeded by concatenations of standard processes.

The prior art reveals processes for hydrogenation of petroleum fractions that are particularly high in aromatic compounds that use a catalyst, for example Patent U.S. Pat. No. 5,037,532 or the publication "Proceeding of the 14$^{th}$ World Petroleum Congress, 1994, pp. 19-26." These documents note processes leading to obtaining hydrocarbon-containing fractions for which an increase in the cetane number is obtained by an intense hydrogenation of aromatic compounds.

Patent FR 2 777 290 proposes a process that combines hydrocracking with hydrogenation for the purpose of reducing the sulfur content and increasing the cetane number of the fuels that are thus produced. This process, which already has good performance levels, should, however, be the subject of improvements to make it possible to meet increasingly strict requirements that will be imposed in most of the industrialized countries.

An improved process combining hydrocracking with hydrogenation that makes it possible to produce fuels that meet increasingly stringent requirements, not only with a maximum sulfur content of 350 ppm, preferably 50 ppm, and a minimum cetane number of 51, preferably 53, in particular 58, but also a maximum temperature T95 of 360° C., preferably 340° C., a maximum content of polyaromatic compounds of 11% by weight, preferably 6% by weight, in particular 1% by weight, and a maximum density d15/4 of 0.845 g/cm$^3$, preferably 0.825 g/cm$^3$, was found. The fuels obtained by this improved process thus have a high cetane number, and a reduced sulfur content that meets the current and future requirements. In addition, they have a boiling point T95, a density d15/4, and polyaromatic compound contents that are adequately reduced to make it possible to meet not only the current requirements and preferably expectations of future European requirements of 2005.

An object of this invention is also to provide a process that can be operated under simple and economically viable conditions, and in particular that do not involve high pressures and that lead to good gas oil yields.

The main object of this invention is therefore to provide a process for conversion of a gas oil fraction, in particular a gas oil fraction with a high content of aromatic or naphtheno-aromatic compounds, making it possible to improve its cetane number and to reduce its contents of sulfur, and aromatic and polyaromatic compounds while reducing its temperature T95 (ASTM D86) and its density d15/4, so as to meet the most stringent future requirements that will be applied to the gas oil fractions.

The invention therefore relates to a process for transforming a gas oil fraction that comprises:

a) at least one hydrorefining stage during which the gas oil fraction is brought into contact with a catalyst, in the presence of hydrogen and at a temperature TR1, whereby said catalyst comprises:

an amorphous mineral substrate, at least one metal of group VIB of the periodic table, at least one non-noble metal of group VIII of said classification, and at least one promoter element that is selected from the group that consists of phosphorus, boron, silicon and fluorine, and b) at least one subsequent hydrocracking stage during which at least a portion of the products that are obtained from the hydrorefining stage are brought into contact with a catalyst in the presence of hydrogen and at a temperature TR2, whereby said catalyst comprises:

at least one zeolite, a mineral binder, and at least one non-noble metal of group VIII, in which the conversion of products that have a boiling point that is less than 150° C. is, throughout the two stages of hydrocracking and hydrorefining, less than 40% by weight and, for the hydrorefining stage, between 1 and 15% by weight, and in that the temperature, TR2, of the hydrocracking stage is less than the temperature, TR1, of the hydrorefining stage and in that the variation between temperatures TR1 and TR2 is between 0 and 80° C.

The operating conditions of the process of the invention have led, surprisingly enough, not only to fuels that have a reduced sulfur content and a higher cetane number, but also to a boiling point, T95, of 95% of the components, to an aromatic compound content and a density d15/4, at 15° C. that have lower values.

The gas oil feedstocks that are to be treated are generally light gas oils, such as, for example, direct distillation gas oils, fluid catalytic cracking gas oils (English initials FCC for Fluid Catalytic Cracking) or (LCO). They generally have an initial boiling point of at least 180° C. and a final boiling point of at most 370° C. The composition by weight of these feedstocks by hydrocarbon family is variable according to the intervals. According to the compositions that are usually encountered, the paraffin contents are between 5.0 and 30.0% by weight, and the contents of naphthenes are between 5.0 and 60% by weight. The gas oil feedstocks preferably have an aromatic compound content (including polyaromatic compounds and naphtheno-aromatic compounds) of between 20% and 90%, in particular between 40% and 80% by weight.

The process according to the invention makes it possible, during the first hydrorefining stage, to reduce the sulfur content, the nitrogen content, and the content of aromatic and polyaromatic compounds, as well as to increase the cetane number.

According to an aspect of the invention, the conversion of products that have a boiling point that is less than 150° C. is limited to the hydrorefining stage. Thus, the conversion of products that have a boiling point that is less than 150° C. is, for the hydrorefining stage, between 1 and 15%, preferably 5 and 15% by weight. The operating conditions that are to be applied to ensure these conversion levels promote the reduction of the content of aromatic compounds by hydrogenating them and increasing the cetane number.

Moreover, the conversion of products that have a boiling point that is less than 150° C. is also, throughout the two stages of hydrorefining and hydrocracking, kept below a certain limit, beyond which it was found that the cetane number runs the risk of being reduced because of the presence of aromatic compounds. Thus, the conversion of products that have a boiling point that is less than 150° C. is, throughout the two stages of hydrorefining and hydrocracking, less than 40%, preferably less than 35%, in particular less than 30%, and, for example, less than 25% by weight.

According to another aspect of the invention, a zeolitic catalyst is used during the hydrocracking stage at a lower temperature than that of the hydrorefining stage. It was noted with surprise that this made it possible to complete the hydrogenation of the aromatic and polyaromatic compounds while making it possible, nevertheless, to carry out a moderate cracking of the feedstock, since said cracking is carried out at relatively low temperatures. Thus, the variation between temperature TR1 of the hydrorefining stage and temperature TR2 of the hydrocracking stage is between 0 and 80° C. This variation is preferably between 5° C. and 70° C., especially between 10° C. and 60° C., in particular between 15° C. and 50° C. Alternately, this variation can be between 11° C. and 70° C., preferably between 13° C. and 60° C., in particular between 15° C. and 50° C.

The process of the invention thus makes it possible to increase, during the hydrocracking stage, the cetane number while reducing the density, d15/4, and the temperature, T95, of the gas oil fraction. The fuel that is produced thus meets the most stringent future requirements.

According to the invention, the catalyst that is used during the hydrorefining stage of the process of this invention, also called hydrorefining catalyst, comprises on an amorphous mineral substrate at least one metal of group VIB of the periodic table, at least one non-noble metal of group VIII of this same classification and at least one promoter element. The metals of groups VIB and VIII constitute the hydro-dehydrogenating element of the hydrorefining catalyst.

Advantageously, during the hydrorefining stage, the feedstock is brought into contact with a hydrorefining catalyst that comprises at least one substrate, at least one element of group VIB of the periodic table, at least one element of group VIII of this same classification, at least one promoter element, whereby the latter is deposited on said catalyst, optionally at least one element of group VIIB such as manganese, and optionally at least one element of group VB such as niobium.

According to the invention, the promoter element is selected from the group that consists of phosphorus, boron, silicon and fluorine.

The hydrorefining catalyst preferably comprises boron and/or silicon, as well as optionally, and preferably, phosphorus as promoter elements. The contents of boron, silicon, and phosphorus are then generally, for each of these elements, between 0.1 and 20% by weight, preferably between 0.1 and 15% by weight, in particular between 0.1 and 10% by weight. The presence of phosphorus provides at least two advantages to the hydrorefining catalyst. The phosphorus facilitates the impregnation of the nickel and molybdenum solutions, and it also improves the hydrogenation activity.

The amorphous mineral substrates of the hydrorefining catalyst can be used by themselves or in a mixture. These substrates of the hydrorefining catalyst can be selected from among alumina, halogenated alumina, silica, silica-alumina, clays, magnesia, titanium oxide, boron oxide, zirconia, aluminum phosphates, titanium phosphates, zirconium phosphates, carbon and aluminates. Among the clays, it is possible to select natural clays, such as kaolin or bentonite. The substrates that are used preferably contain alumina, under all these forms known to one skilled in the art, and even more preferably are aluminas, for example garnma-alumina.

The hydro-dehydrogenating function of the hydrorefining catalyst is generally performed by at least one metal of group VIB of the periodic table and at least one non-noble metal of group VIII of this same classification, whereby these metals are preferably selected from among molybdenum, tungsten, nickel and cobalt. In particular, this function can be ensured by the combination of at least one element of group VIII (Ni, Co) with at least one element of group VIB (Mo, W).

According to a preferred method of the invention, the hydrorefining catalyst that comprises phosphorus is such that the total concentration in metal oxides of groups VIB and VIII is between 5 and 40% by weight, preferably between 7 and 30% by weight. The ratio by weight that is expressed in terms of metal oxide between group VIB metal (or metals) vs. group VIII metal (or metals) is preferably between 20 and 1.25, even more preferably between 10 and 2. Furthermore, the concentration of phosphorus oxide $P_2O_5$ in this catalyst is preferably less than 15% by weight, in particular less than 10% by weight.

According to another preferred method of the invention, the hydrorefining catalyst comprises boron and/or silicon, preferably boron and silicon. Advantageously, the hydrorefining catalyst comprises a percentage by weight relative to the total mass of the catalyst:

- 3 to 60%, preferably 3 to 45%, even more preferably 3 to 30% of at least one metal of group VIB,
- 0.5 to 30%, preferably 0.5 to 25%, even more preferably 0.5 to 20% of at least one metal of group VIII,
- 0.1 to 99%, preferably 10 to 98%, for example 15 to 95% of at least one amorphous mineral substrate,
- 0.1 to 20%, preferably 0.1 to 15%, even more preferably 0.1 to 10% of boron and/or 0.1 to 20%, preferably 0.1 to 15%, even more preferably 0.1 to 10% of silicon,
- optionally 0 to 20%, preferably 0.1 to 15%, even more preferably 0.1 to 10% of phosphorus, and
- optionally 0 to 20%, preferably 0.1 to 15%, even more preferably 0.1 to 10% of at least one element that is selected from group VIIA, preferably fluorine.

In a general way, the formulations that have the following atomic ratios are preferred:

- an atomic ratio: group VIII metal/group VIB metal of between 0 and 1,
- an atomic ratio: B/group VIB metals of between 0.01 and 3,
- an atomic ratio: Si/group VIB metals of between 0.01 and 1.5,
- an atomic ratio: P/group VIB metals of between 0.01 and 1,
- an atomic ratio: group VIIA metal/group VIB metals of between 0.01 and 2.

Such a hydrorefining catalyst has an activity of hydrogenation of aromatic hydrocarbons, hydrodenitrating and hydrodesulfurization that is more significant than the catalytic formulas without boron and/or silicon. This type of catalyst also has a more significant activity and selectivity of hydrocracking than the catalytic formulas known in the prior art. A catalyst that comprises boron and silicon is particularly active, which induces, on the one hand, an improvement in hydrogenating, hydrodesulfurizing and hydrodenitrating properties, and, on the other hand, an improvement in the activity of hydrocracking relative to the catalysts that are usually used in the hydrorefining and hydroconversion reactions.

According to another preferred method of the invention, the preferred hydrorefining catalysts are the catalysts NiMo and/or NiW on alumina, also the catalysts NiMo and/or NiW on alumina that is doped with at least one element included in the group of atoms that consists of phosphorus, boron, silicon and fluorine. Other preferred catalysts are the catalysts NiMo and/or NiW on silica-alumina or on silica-alumina-titanium oxide that may or may not be doped, by at least one element that is included in the group of atoms that consists of phosphorus, boron, fluorine and silicon.

This type of hydrorefining catalyst preferably comprises:

- 5 to 40% by weight of at least one non-noble element of groups VIB and VIII (% oxide),
- 0.1 to 20% by weight of at least one promoter element that is selected from among phosphorus, boron, and silicon (% oxide),
- 0 to 20% by weight of at least one element of group VIIB (manganese, for example),
- 0 to 20% by weight of at least one element of group VIIA (fluorine, chlorine, for example),
- 0 to 60% by weight of at least one element of group VB (niobium, for example), and
- 0.1 to 95% by weight of at least one matrix, and preferably alumina.

The hydrorefining stage is advantageously carried out at a pressure of 5 to 15 MPa, preferably 6 to 13 MPa, even more preferably 7 to 11 MPa, and at a temperature of 310° C. to 420° C., preferably 320 to 400° C., even more preferably 340 to 400° C. The recycling of pure hydrogen per volume of feedstock can be advantageously between 200 and 2500 $Nm^3/m^3$ of feedstock, preferably between 300 and 2000 $Nm^3/m^3$. The volumetric flow rate can be between 0.1 and 5, preferably between 0.1 and 3 that is expressed by volume of liquid feedstock per volume of catalyst and per hour.

The targeted content of organic nitrogen is generally less than 50 ppm by mass, preferably less than 20 ppm, in particular less than 10 ppm by mass.

Preferably, all of the products that are obtained from the hydrorefining stage are engaged in the hydrocracking stage of the process of the invention. The hydrorefining stage and the hydrocracking stage generally take place in at least two separate reaction zones. These reaction zones can be contained in one or more reactors.

The catalyst that is used during the hydrocracking stage of the process of the invention, also called hydrocracking catalyst, comprises at least one zeolite that can preferably be selected from the group that consists of the Y zeolite (of FAU structural type), the NU-86 zeolite, and the beta zeolite (of BEA structural type). This hydrocracking catalyst also comprises at least one mineral binder (or matrix) and a hydro-dehydrogenating element. This catalyst can optionally comprise at least one element that is selected from the group that consists of boron, phosphorus, silicon, at least one element of group VIIA (chlorine, fluorine, for example), at least one element of group VIIB (manganese, for example), and at least one element of group VB (niobium, for example).

The catalyst can also comprise, as a mineral binder, at least one porous or poorly crystallized mineral matrix of oxide type. It is possible to cite, by way of example, aluminas, silicas, silica-aluminas, aluminates, alumina-boron oxide, magnesia, silica-magnesia, zirconia, titanium oxide, and clay, by themselves or in mixtures.

The hydro-dehydrogenating function of the hydrocracking catalyst is generally ensured by at least one non-noble element of group VIII of the periodic table (for example cobalt and/or nickel) and optionally at least one element of group VIB of the same classification (for example molybdenum and/or tungsten).

The hydro-dehydrogenating function of the hydrocracking catalyst is ensured by at least one non-noble element of group VIII (for example cobalt and/or nickel) and at least one element of group VIB (for example molybdenum and/or tungsten).

Thus, according to this other preferred method of the invention, the hydrocracking catalyst comprises at least one non-noble metal of group VIII, at least one metal of group VIB, at least one zeolite, and a mineral binder such as alumina. The hydrocracking catalyst preferably essentially comprises nickel, molybdenum, alumina and a zeolite that is selected from the group that consists of the Y zeolite and the NU-86 zeolite.

According to another preferred method of the invention, the hydrocracking catalyst comprises at least one element that is selected from the group that consists of boron, silicon and phosphorus. In addition, the hydro cracking catalyst optionally comprises at least one element of group VIIA, such as chlorine and fluorine, optionally at least one element of group VIIB such as manganese, and optionally at least one element of group VB such as niobium. The boron, silicon and/or phosphorus can be in the matrix or in the zeolite. These compounds are preferably deposited on the catalyst, and are then basically located on the matrix. A preferred hydrocracking catalyst contains, as promoter element(s), boron and/or silicon deposited with, preferably, also phosphorus that is used as a promoter element. The amounts that are introduced are generally 0.1-20% by weight of catalyst calculated in terms of oxide.

The hydrocracking catalyst advantageously comprises:

- 0.1 to 80% by weight of a zeolite that is selected from among the Y, beta and NU-86 zeolites,
- 0.1 to 40% by weight of at least one element of group VIII, and optionally VIB, (expressed in % oxide),
- 0.1 to 99.8% by weight of mineral binder (or matrix) (expressed in % oxide),
- 0 to 20% by weight, preferably 0.1 to 20% of at least one element that is selected from the group that consists of phosphorus, boron, and silicon (added and not the one that is present in the zeolite) (expressed in % oxide),
- 0 to 20% by weight, preferably 0.1 to 20% by weight of at least one element of group VIIA,
- 0 to 20% by weight, preferably 0.1 to 20% by weight of at least one element of group VIIB, and
- 0 to 60% by weight, preferably 0.1 to 60% by weight of at least one element of group VB.

The zeolite optionally can be doped by metallic elements such as, for example, the metals of the family of rare earths, in particular lanthanum and cerium, or else noble metals or non-noble metals of group VIII, such as platinum, palladium, ruthenium, rhodium, iridium, iron, and other metals such as manganese, zinc, or magnesium.

An H—Y acid zeolite is particularly advantageous and has specific requirements such as:

- an $SiO_2/Al_2O_3$ overall molar ratio that is between about 6 and 70, preferably between about 12 and 50,
- a sodium content that is less than 0.15% by weight (determined on the zeolite that is calcined at 1 100° C.),
- a crystalline parameter of the elementary mesh of between 2.424 nm and 2.458 nm, preferably between 2.426 nm and 2.438 nm,
- a CNa capacity for sodium ion uptake, expressed in gram of sodium per 100 grams of modified zeolite, neutralized then calcined, greater than about 0.85,
- a specific surface area that is determined by the B.E.T. method at greater than about 400 $m^2/g$, preferably greater than 550 $m^2/g$,
- a water vapor adsorption capacity at 25° C. for a partial pressure of 2.6 torrs (or 34.6 MPa), greater than about 6%,
- optionally a porous distribution, determined by nitrogen physisorption, that comprises between 5 and 45%, preferably between 5 and 40% of the total pore volume of the zeolite that is contained in pores that have a diameter of between 2 nm and 8 nm, and between 5 and 45%, preferably between 5 and 40% of the total pore volume of the zeolite that is contained in pores that have a diameter that is greater than 8 nm and generally less than 100 nm, whereby the remainder of the pore volume is contained in the pores that have a diameter that is less than 2 nm.

A dealuminified Y zeolite is also advantageous and has specific requirements such as:

- a crystalline parameter of between 2.424 nm and 2.455 nm, preferably between 2.426 and 2.438 nm,
- an overall $SiO_2/Al_2O_3$ molar ratio that is greater than 8,
- a content of alkaline-earth or alkaline metal cations and/or rare earth cations such that the atomic ratio $(n \times M^{n+})/Al$ is less than 0.8, preferably less than 0.5, in particular 0.1,
- a specific surface area that is determined by the B.E.T. method that is greater than 400 $m^2/g$, preferably greater than 550 $m^2/g$, and
- a water adsorption capacity at 25° C. for a value P/Po of 0.2, greater than 6% by weight.

In the case of a catalyst that uses a dealuminified Y zeolite, said catalyst also comprises at least one metal that has a hydro-dehydrogenating function and silicon that is deposited on said catalyst.

According to an advantageous method of the invention, a catalyst that comprises a partially amorphous Y zeolite is used during the hydrocracking stage. A partially amorphous Y zeolite is defined as a solid that has:

- a peak rate that is less than 0.40, preferably less than about 0.30,
- a crystalline fraction that is expressed relative to a reference Y zeolite in a form that contains soda (Na) that is less than about 60%, preferably less than about 50%, whereby said fraction is determined by x-ray diffraction.

The solid, partially amorphous Y zeolites that enter the composition of the hydrocracking catalyst of the process of the invention preferably have at least one, preferably all, of the other characteristics below:

- an overall Si/Al ratio that is greater than 15, preferably greater than 20 and less than 150,
- an $Si/Al^{IV}$ framework ratio that is greater than or equal to the overall Si/Al ratio,
- a pore volume that is at least equal to 0.20 ml per g of solid of which a fraction, between 8% and 50%, consists of pores that have a diameter of at least 50 Å,
- a specific surface area of 210 to 800 $m^2/g$, preferably 250 to 750 $m^2/g$, in particular 300 to 600 $m^2/g$.

The peak rates and the crystalline fractions are determined by x-ray diffraction relative to a reference zeolite by using a procedure that is derived from the ASTM D3906-97 method "Determination of Relative X-Ray Diffraction Intensities of Faujasite-Type-Containing Materials." It is possible to refer to this method for the general conditions for application of the procedure and, in particular, for the preparation of samples and references.

A diffractogram consists of characteristic lines of the crystallized fraction of the sample and a bottom, essentially created by the diffusion of the amorphous fraction or microcrystalline fraction of the sample (a weak diffusion signal is related to the equipment, air, sampling device, etc . . . ). The peak rate of a zeolite is the ratio, in a predefined angular zone (typically 8 to 40° 2θ when radiation Kα of copper is used, 1=0.154 nm), of the area of the lines of the zeolite (peaks) to the global area of the diffractogram (peaks+bottom). This ratio of peaks/(peaks+bottom) is proportional to the amount of crystallized zeolite in the material. To estimate the crystalline fraction of a Y zeolite sample, the peak rate of the sample is compared to that of a reference being considered as 100% crystallized (NaY, for example). The peak rate of a perfectly crystallized NaY zeolite is on the order of 0.55 to 0.60. The peak rate of a standard USY zeolite is 0.45 to 0.55; its crystalline fraction relative to a perfectly crystallized NaY is 80 to 95%.

The peak rate of the solid that is the object of this invention is less than 0.4 and preferably less than 0.35. Its crystalline fraction is therefore less than 70%, preferably less than 60%.

The partially amorphous zeolites are prepared according to the techniques that are generally used for dealuminification, starting from Y zeolites that are available commercially, i.e., that generally have high crystallinity (at least 80%). More generally, it will be possible to start from zeolites that have a crystalline fraction of at least 60% or at least 70%.

The Y zeolites that are generally used in the hydrocracking catalysts are produced by modification of Na-Y zeolites that are available commercially. This modification makes it possible to achieve so-called stabilized, ultra-stabilized or else dealuminified zeolites. This modification is carried out by at least one of the dealuminification techniques, and, for example, the hydrothermic treatment, the acid attack. This modification is preferably carried out by a combination of three types of operations that are known to one skilled in the art: hydrothermic treatment, ion exchange and acid attack.

According to another advantageous method of the invention, a catalyst that comprises a globally non-dealuminified and very acidic Y zeolite can be used during the hydrocracking stage. A globally non-dealuminified zeolite is defined as a Y zeolite (FAU structural type, faujasite) according to the nomenclature developed in "Atlas of Zeolite Structure Types," W. M. Meier, D. H. Olson and Ch. Baerlocher, $4^{th}$ Revised Edition 1996, Elsevier.

During the preparation of this zeolite, the crystalline parameter can be reduced by extraction of aluminum from the structure (or framework). The overall $SiO_2/Al_2O_3$ ratio generally remains unchanged because the aluminum has not been extracted chemically. Such a globally non-dealuminified zeolite therefore has an overall $SiO_2/Al_2O_3$ ratio that also remains unchanged.

This globally non-dealuminified Y zeolite can come either in hydrogenated form or at least partially exchanged with metallic cations, for example with alkaline-earth metal cations, including rare earth metal cations of atomic numbers 57 to 71. A zeolite that is lacking in rare earth and alkaline-earth is generally preferred.

The globally non-dealuminified Y zeolite generally has a crystalline parameter that is greater than 2.438 nm, an overall $SiO_2/Al_2O_3$ ratio that is less than 8, an $SiO_2/Al_2O_3$ framework molar ratio that is less than 21 and greater than the overall $SiO_2/Al_2O_3$ ratio.

The globally non-dealuminified zeolite can be obtained by any treatment that does not extract aluminum from the sample, such as, for example, a treatment with water vapor or a treatment by $SiCl_4$.

Thus, according to a method of the process of the invention, the hydrocracking catalyst contains an acidic amorphous oxide matrix of alumina type that is doped by phosphorus, a globally non-dealuminified and very acidic Y zeolite, and optionally at least one element of group VIIA and in particular fluorine.

Among the zeolites that can be used in the process of the invention, it is possible to cite the beta zeolite of BEA structural type according to the developed nomenclature in "Atlas of Zeolite Structure Types," W. M. Meier, D. H. Olson and Ch. Baerlocher, $4^{th}$ Revised Edition, 1996, Elsevier. This beta zeolite can be used in its H-beta acid form or partially exchanged by cations. The Si/Al ratio of the beta zeolite can be the one that is obtained during its synthesis or else it can undergo post-synthesis dealuminification treatments that are known by one skilled in the art.

The NU-86 zeolite, which can also be used advantageously in the process of the invention, is described in U.S. Pat. No. 5,108,579. This zeolite can be used in its H-NU-86 acid form or partially exchanged by cations. The NU-86 zeolite can also be used after having undergone one or more treatments of post-synthesis dealuminification so as to increase its Si/Al ratio and thus to adjust its catalytic properties. The post-synthesis dealuminification techniques are described in U.S. Pat. No. 6,165,439.

The hydrocracking stage is advantageously carried out at a pressure of 5 to 15 MPa, preferably 6 to 13 MPa, even more preferably 7 to 11 MPa and at a temperature of 290 to 400° C., preferably 310° C. to 390° C., and even more preferably 320 to 380° C. The recycling of pure hydrogen can be between 200 and 2500 $Nm^3/m^3$, preferably between 300 and 2000 Nm3/m3.

Prior to the hydrorefining stage and/or the hydrocracking stage of the process of this invention, the hydrorefining catalyst and/or hydrocracking catalyst can be subjected to a sulfurization treatment that makes it possible to transform, at least in part, the metal sulfide radicals before they are brought into contact with the feedstock that is to be treated. This treatment of activation by sulfurization is well known to one skilled in the art and can be carried out by any method that is already described in the literature or in situ, i.e., in the reactor, or ex situ.

A standard sulfurization method that is well known to one skilled in the art consists in heating in the presence of hydrogen sulfide (pure or, for example, under a stream of a hydrogen/hydrogen sulfide mixture) at a temperature of between 150 and 800° C., preferably between 250 and 600° C., generally in a flushed-bed reaction zone.

The outlet effluent of the second reaction zone that corresponds to the hydrocracking stage of the process according to the invention can be subjected to a so-called final separation (for example an atmospheric distillation) so as to separate the gases (such as aimonia $NH_3$ and hydrogen sulfide ($H_2S$), as well as the other light gases that are present, hydrogen, and conversion products (gasoline fraction).

The following examples illustrate the invention without limiting its scope.

EXAMPLE 1

The treated feedstock in this example is a naphtheno-aromatic gas oil that is obtained from distillation and whose characteristics are as follows:

TABLE 1

| Physico-Chemical Characteristics of the Feedstock | |
|---|---|
| d15/4 | 0.9045 |
| S content (% by weight) | 2.2 |
| Engine cetane | 34 |
| Content of aromatic compounds (including the polyaromatic compounds) | 47.2 |
| Content of polyaromatic compounds | 20.4 |
| T95% (ASTM D86) (° C.) | 351 |

This feedstock was introduced into a catalytic test unit that comprises 2 reactors. Used in the upstream reactor is a catalyst that comprises alumina, 3.6% by weight of nickel (oxide), 17.2% by weight of molybdenum (oxide), and 4% by weight of phosphorus (oxide), and used in the downstream reactor is a hydrocracking zeolitic catalyst that comprises alumina, a Y zeolite, nickel and molybdenum.

The operating conditions that are used are as follows:

Total pressure=90 bar $H_2$/H C=1000 liters of hydrogen/liter of feedstock

Overall VVH=0.6 $h^{-1}$

TR1=360° C.

TR2=348° C.

The outlet effluent of the unit was subjected to distillation so as to recover the fraction whose compounds have a boiling point that is greater than 150° C. This fraction was then analyzed, and the characteristics of said fraction are combined in Table 2 below.

TABLE 2

| Characteristics of the 150° C.$^+$ Fraction After Treatment | |
|---|---|
| d15/4 | 0.8402 |
| S content, ppm by weight | 9 |
| Engine cetane | 53 |
| Content of aromatic compounds (% by weight) | 5.6 |
| Content of polyaromatic compounds (% by weight) | 0.4 |
| T95% (ASTM D86) (° C.) | 325 |

The yield of the gas oil fraction of 150° C.$^+$ is 88% by weight (conversion of 12% by weight). The table above shows that all of the characteristics of the 150° C.$^+$ gas oil fraction obtained by the process according to the invention are significantly improved and make it possible to meet the most stringent future requirements.

EXAMPLE 2

The treated feedstock in this example is identical to the one of Example 1.

The operating conditions that are used are as follows:

Total pressure=90 bar $H_2$/HC=1000 liters of hydrogen/liter of feedstock

Overall VVH=0.6 $h^{-1}$

TR1=360° C.

TR2=340° C.

The outlet effluent of the unit undergoes distillation so as to recover the 150° C.$^+$ fraction that is then analyzed and whose characteristics are combined in Table 3 below.

TABLE 3

| Characteristics of the 150° C.$^+$ Fraction After Treatment | |
|---|---|
| d15/4 | 0.8432 |
| S content, ppm by weight | 8 |
| Engine cetane | 53 |
| Content of aromatic compounds (% by weight) | 3.1 |
| Content of polyaromatic compounds (% by weight) | 0.25 |
| T95% (ASTM D86) (° C.) | 339 |

The yield of the gas oil fraction of 150° C$^+$ is 92% by weight (conversion of 8% by weight). The table above shows that all of the characteristics of the 150° C.$^+$ gas oil fraction obtained by the process according to the invention are also improved and make it possible to meet the most stringent future requirements.

EXAMPLE 3 (For Comparison)

For a feedstock that is identical to the one of Example 1, the operating conditions that are used are as follows:

Total pressure=90 bar $H_2$/HC=1000 liters of hydrogen/liter of feedstock

Overall vvh=0.6 $h^{-1}$

TR1=360° C.

TR2=380° C.

The outlet effluent of the unit undergoes distillation so as to recover the 150° C.$^+$ fraction that is then analyzed and whose characteristics are combined in Table 4 below.

TABLE 4

| Characteristics of the 150° C.$^+$ Fraction After Treatment | |
|---|---|
| d15/4 | 0.8112 |
| S content, ppm by weight | 6 |
| Engine cetane | 44 |
| Content of aromatic compounds (% by weight) | 12.9 |
| Content of polyaromatic compounds (% by weight) | 1.2 |
| T95% (ASTM D86) (° C.) | 281 |

The yield of the 150° C.$^+$ gas oil fraction is 43% by weight (conversion of 57% by weight). The fuel that is obtained does not have quality that meets the requirements imposed in industrialized countries. It is noted in particular that the cetane number is below 51.

The preceding examples can be repeated with similar success by substituting the generically or specifically described reactants and/or operating conditions of this invention for those used in the preceding examples.

The entire disclosure of all applications, patents and publications, cited herein and of corresponding French application No. 02/01.971, filed Feb. 15, 2002 is incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for transforming a gas oil fraction, said process comprising:

at least one hydrorefining stage during which a gas oil fraction having an initial boiling point of at least 180° C. and a final boiling point of at most 370° C. is brought into contact with a catalyst, in the presence of hydrogen and at a temperature TR1, whereby said catalyst comprises:

an amorphous mineral substrate, at least one metal of group VIB of the periodic table, at least one non-noble metal of group VIII of the periodic table, and at least one promoter element that is ef phosphorus, boron, silicon or fluorine, and b) at least one subsequent hydrocracking stage during which at least a portion of the products that are obtained from the hydrorefining stage are brought into contact with a catalyst in the presence of hydrogen and at a temperature TR2, whereby said catalyst comprises:

at least one Y zeolite of FAU structure, an NU-86 zeolite or a beta zeolite of BEA structure, a mineral binder, and at least one non-noble metal of group VIII, wherein the conversion of products that have a boiling point that is less than 150° C. is, throughout the two stages of hydrocracking and hydrorefining, less than 40% by weight and, for the hydrorefining stage, between 1 and 15% by weight, and in that the temperature, TR2, of the hydrocracking stage, is less than the temperature, TR1, of the hydrorefining stage, and in that the variation between temperatures TR1 and TR2 is between 5 and 70° C.

2. A process according to claim 1, wherein the gas oil fraction that constitutes the feedstock comprises between 20% and 90% by weight of aromatic compounds.

3. A process according to claim 1, wherein the conversion of products that have a boiling point that is less than 150° C. is, for the hydrorefining stage, between 5 and 15% by weight.

4. A process according to claim 1, wherein the conversion of products that have a boiling point that is less than 150° C. is, throughout the two stages of hydrorefining and hydrocracking, less than 25%.

5. A process according to claim 1, wherein the variation between temperature TR1 of the hydrorefining stage and temperature TR2 of the hydrocracking stage is between 10° C. and 60° C.

6. A process according to claim 1, wherein the variation between temperature TR1 of the hydrorefining stage and temperature TR2 of the hydrocracking stage is between 15° C. and 50° C.

7. A process according to claim 1, wherein the hydrorefining catalyst comprises, as promoter elements, boron and/or silicon, as well as phosphorus, and wherein the contents of boron, silicon, and phosphorus are, for each of these elements present, between 0.1 and 20% by weight.

8. A process according to claim 1, wherein a hydrodehydrogenating function of the hydrorefining catalyst is performed by at least one metal of group VTB of the periodic table that is molybdenum or tungsten, and at least one non-noble metal of group VIII that is nickel or cobalt.

9. A process according to claim 1, wherein the hydrorefining catalyst comprises phosphorus and is such that:

the total concentration of metal oxides of groups VIB and VIII is between 5 and 40% by weight, the ratio by weight that is expressed in terms of metal oxide between group VIB metal (or metals) vs. group VIII metal (or metals) is between 20 and 1.25, the concentration of phosphorus oxide P205 is less than 15% by weight.

10. A process according to claim 1, wherein the catalyst that is used during the hydrocracking stage comprises at least one non-noble metal of group VIII, at least one metal of group VIB, at least one zeolite, and a mineral binder such as alumina.

11. A process for transforming a gas oil fraction, said process comprising:

at least one hydro refining stage during which a gas oil fraction having an initial boiling point of at least 180° C. and a final boiling point of at most 370° C. is brought into contact with a catalyst, in the presence of hydrogen and at a temperature TR1, whereby said catalyst comprises:

an amorphous mineral substrate, at least one metal of group VIIB of the periodic table, at least one non-noble metal of group VIII of the periodic table, and at least one promoter element that is ef phosphorus, boron, silicon or fluorine, and b) at least one subsequent hydrocracking stage during which at least a portion of the products that are obtained from the hydro refining stage are brought into contact with a catalyst in the presence of hydrogen and at a temperature TR2, whereby said catalyst consists of:

at least one Y-zeolite of FAU structure, a mineral binder, and at least one non-noble metal of group VIII, wherein the conversion of products that have a boiling point that is less than 150° C. is, throughout the two stages of hydrocracking and hydro refining, less than 40% by weight and, for the hydro refining stage, between 1 and 15% by weight, and in that the temperature, TR2, of the hydrocracking stage, is less than the temperature, TR1, of the hydro refining stage, and in that the variation between temperatures TR1 and TR2 is between 5 and 70° C.

12. A process for transforming a gas oil fraction having an initial boiling point of at least 180° C. and a final boiling point of at least 370° C., said process comprising:

a) at least one hydro refining stage during which a gas oil fraction having an initial boiling point of at least 180° C. and a final boiling point of at most 370° C. is brought into contact with a catalyst, in the presence of hydrogen and at a temperature TR1, whereby said catalyst comprises:

an amorphous mineral substrate, at least one metal of group VIB of the periodic table, at least one non-noble metal of group VIII of the periodic table, and at least one promoter element that is ef phosphorus, boron, silicon or fluorine, and b) at least one subsequent hydrocracking stage during which at least a portion of the products that are obtained from the hydro refining stage are brought into contact with a catalyst in the presence of hydrogen and at a temperature TR2, whereby said catalyst comprises:

at least one Y-zeolite of FAU structure, an NU-86 zeolite or a beta zeolite of BEA structure, a mineral binder, and at least one non-noble metal of group VIII, wherein the conversion of products that have a boiling point that is less than 150° C. is, throughout the two stages of hydrocracking and hydro refining, less than 40% by weight and, for the hydro refining stage, between 1 and 15% by weight, and in that the temperature, TR2, of the hydrocracking stage, is less than the temperature, TR1, of the hydro refining stage, and in that the variation between temperatures TR1 and TR2 is between 5 and 70° C., whereby a product is produced which has a maximum sulfur content of 350 ppm, a minimum cetane number of 51, a maximum temperature T95 of 360° C., a maximum content of polyaromatic compounds of 11% by weight, and a maximum density d15/4 of 0.845 g/cm3.

13. A process according to claim 11, wherein the conversion of products that have a boiling point that is less than 150° C. is, throughout the two stages of hydro refining and hydrocracking, less than 25%.

14. A process according to claim 12, wherein the conversion of products that have a boiling point that is less than 150° C. is, throughout the two stages of hydro refining and hydrocracking, less than 25%.

* * * * *

UNITED STATES PATENT AND TRADEMARK OFFICE

CERTIFICATE OF CORRECTION

PATENT NO. : 7,381,321 B2
APPLICATION NO. : 10/367965
DATED : June 3, 2008
INVENTOR(S) : Benazzi et al.

It is certified that error appears in the above-identified patent and that said Letters Patent is hereby corrected as shown below:

Column 13, line 8, delete “ef”.

Column 13, line 54, change “VTB” to --VIB--.

Column 14, line 6, reads “at least one hydro refining stage during which a gas oil”, should read --a) at least one hydro refining stage during which a gas oil--.

Column 14, line 13, change “VIIB” to --VIB--.

Column 14, line 16, delete “ef”.

Column 14, line 48, delete “ef”.

Signed and Sealed this

Thirty-first Day of March, 2009

John Doll

JOHN DOLL
*Acting Director of the United States Patent and Trademark Office*